US007546701B2

(12) United States Patent
Alipour

(10) Patent No.: US 7,546,701 B2
(45) Date of Patent: Jun. 16, 2009

(54) AUTOMATIC STANDBY ELECTRIC CLOTHES IRON

(76) Inventor: Ehsan Alipour, 1095 Folsom St., San Francisco, CA (US) 94103

( * ) Notice: Subject to any disclaimer, the term of this patent is extended or adjusted under 35 U.S.C. 154(b) by 0 days.

(21) Appl. No.: 11/434,650

(22) Filed: May 15, 2006

(65) Prior Publication Data

US 2006/0254097 A1 Nov. 16, 2006

Related U.S. Application Data

(63) Continuation-in-part of application No. 11/137,921, filed on May 25, 2005, now Pat. No. 7,406,783.

(60) Provisional application No. 60/680,566, filed on May 13, 2005.

(51) Int. Cl.
*D06F 75/40* (2006.01)
*D06F 77/00* (2006.01)

(52) U.S. Cl. ..... 38/79; 38/89

(58) Field of Classification Search ..... 38/74, 38/77.1–77.81, 79, 81, 88, 89, 90, 93, 96, 38/97; 219/250, 257, 259
See application file for complete search history.

(56) References Cited

U.S. PATENT DOCUMENTS

| | | | |
|---|---|---|---|
| 514,492 | A | 2/1894 | Nugent |
| 1,366,480 | A | 1/1921 | Oca-Balda |
| 1,694,668 | A | 12/1928 | Pandolfo |
| 1,920,668 | A | 8/1933 | Reed |
| 2,072,217 | A | 3/1937 | Reed |
| 2,076,614 | A | 4/1937 | Bowman |
| 2,149,251 | A | 3/1939 | Campana |
| 2,211,839 | A | 8/1940 | Simonsen |
| 2,224,896 | A | 12/1940 | Burian |
| 2,308,941 | A | 1/1943 | Stevenson |
| 2,422,505 | A | 6/1947 | Tangeman et al. |
| 2,422,856 | A | 6/1947 | Schara |
| 2,470,532 | A | 5/1949 | Thomas |
| 2,501,549 | A | 3/1950 | Swenson |
| 2,528,821 | A | 11/1950 | Cureton |
| 2,584,071 | A | 1/1952 | Wallis |
| 2,596,314 | A | 5/1952 | Wales |
| 2,602,247 | A | 7/1952 | Chochran |
| 2,642,682 | A | 6/1953 | Browning |
| 2,664,655 | A | 1/1954 | Jepson |
| 2,668,379 | A | 2/1954 | Binggely |
| 2,680,313 | A | 6/1954 | Victor |

(Continued)

FOREIGN PATENT DOCUMENTS

| | | |
|---|---|---|
| DE | 394454 | 4/1924 |

(Continued)

*Primary Examiner*—Ismael Izaguirre
(74) *Attorney, Agent, or Firm*—GSS Law Group

(57) ABSTRACT

An improved electric clothes iron comprises a water tank, chassis, handle, electrically heated soleplate, and steam chamber. The improvement, in one instance, includes heel and toe lifting pistons which are embedded in the soleplate and driven by an electric motor. A grip sensor in the handle triggers the lift piston motor to operate when the user is no longer gripping the handle. The lifting pistons are quickly retracted if the user grabs the handle again. The heated soleplate can be automatically turned off if the iron is left idle too long.

30 Claims, 20 Drawing Sheets

U.S. PATENT DOCUMENTS

| | | | | | |
|---|---|---|---|---|---|
| 2,712,703 | A | | 7/1955 | Hilldale | |
| 2,713,222 | A | | 7/1955 | Brace | |
| 2,716,825 | A | | 9/1955 | Kulicke, Jr. | |
| 2,718,076 | A | | 9/1955 | Brace | |
| 2,749,663 | A | | 6/1956 | Seck | |
| 2,786,287 | A | * | 3/1957 | Swann | 38/77.4 |
| 2,811,793 | A | * | 11/1957 | Humphrey et al. | 38/77.7 |
| 2,817,169 | A | * | 12/1957 | Schott | 38/77.1 |
| 2,861,365 | A | * | 11/1958 | Block | 38/77.82 |
| 3,050,885 | A | | 8/1962 | Whitfield | |
| 3,184,871 | A | * | 5/1965 | Alessandro | 38/77.8 |
| 3,200,521 | A | | 8/1965 | Whitfield | |
| 3,811,208 | A | * | 5/1974 | Vieceli et al. | 38/77.8 |
| 4,233,763 | A | * | 11/1980 | McMullen | 38/77.83 |
| 4,366,367 | A | * | 12/1982 | Mazzucco | 392/335 |
| 4,577,424 | A | * | 3/1986 | Liu | 38/88 |
| 4,748,755 | A | * | 6/1988 | Bain et al. | 38/88 |
| 5,042,179 | A | | 8/1991 | Van der Meer | |
| 5,380,983 | A | * | 1/1995 | Cavada et al. | 219/250 |
| 5,721,418 | A | * | 2/1998 | Hazan et al. | 219/257 |
| 5,852,279 | A | | 12/1998 | Mak | |
| 5,917,165 | A | | 6/1999 | Platt | |
| 5,966,851 | A | | 10/1999 | Serpa | |
| 6,079,133 | A | | 6/2000 | Netten | |
| 6,105,285 | A | | 8/2000 | Nickel | |
| 6,243,976 | B1 | * | 6/2001 | Beverly et al. | 38/77.5 |
| 6,260,295 | B1 | | 7/2001 | Nickel | |
| 6,307,182 | B1 | * | 10/2001 | Lile | 219/257 |
| 6,384,379 | B1 | * | 5/2002 | Reime | 219/257 |
| 6,438,876 | B2 | | 8/2002 | Har | |
| 6,453,587 | B1 | | 9/2002 | Alipour | |
| 6,715,222 | B2 | | 4/2004 | Hecht | |
| 6,925,738 | B2 | | 8/2005 | Alipour | |
| 7,191,554 | B2 | * | 3/2007 | Almanzar et al. | 38/77.5 |

FOREIGN PATENT DOCUMENTS

| | | | |
|---|---|---|---|
| JP | 407185198 | A | 7/1995 |
| WO | WO 02/095120 | A1 | 11/2002 |

* cited by examiner

AUTOMATIC STANDBY ELECTRIC CLOTHES IRON

RELATED APPLICATIONS

This Application claims priority of U.S. Provisional Patent Application Ser. No. 60/680,556, filed May 13, 2005, filed by Ehsan Alipour. This application is also a continuation in part of patent application Ser. No. 11/137,921 filed May 25, 2005, now U.S. Pat. No. 7,460,783 entitled Self Lifting Iron, which claims the priority date of U.S. Pat. No. 6,925,738 issued Aug. 9, 2005 entitled Self Lifting Iron, which claims the priority date of U.S. Pat. No. 6,453,587 issued Sep. 24, 2002 entitled Self Lifting Iron. The patents and applications listed above are hereby incorporated by reference in their entirety.

FIELD OF THE PRESENT INVENTION

The present invention relates to electric clothes irons, and in particular to safety and convenience devices included in such irons to prevent the iron from burning things when laid down flat or wasting energy when left unattended.

BACKGROUND

An electric clothes iron consists essentially of a heated sole plate that is pressed against fabric to remove wrinkles. To be effective, the sole plate of an iron must be very hot. Thus, there is a serious danger of burning the fabric or ironing board or even igniting a fire from an electric iron inadvertently left unattended. In addition, irons are relatively heavy, and awkward. Lifting and placing an iron on its tail can be physically straining on the operator's wrist. Furthermore, when the iron is placed on its tail, the hot sole plate is exposed and may cause accidental contact with the sole plate by the user can result in severe burns.

The inventor describes several solutions to these problems in U.S. Pat. No. 6,453,587, issued Sep. 24, 2002, and U.S. Pat. No. 6,925,738, issued Aug. 9, 2005; which patents are hereby incorporated by reference in their entirety. Here, the iron's hot sole plate is moved away and lifted off the surface it may be resting on. Non-heated heel and toe pistons will emerge from the bottom surface after the user lets go of the handle. The pistons lift the hot sole plate far enough away to prevent garment damage and/or fires, and the electric power may be cut to the sole plate heaters so it will eventually cool down and be safe.

User, manufacturing, and sales experience with these products has lead to many ways that these newest electric clothes irons can be further improved. For example, if an iron is left laid flat on its soleplate, its lifting mechanism should not cause it to roll over on its side. The lifting mechanism should also not interfere with the basic functional parts of the iron, such as the water tank, chassis, soleplate or steam chamber parts.

SUMMARY OF THE PRESENT INVENTION

Briefly, an electric clothes iron embodiment of the present invention comprises a water tank, chassis, handle, electrically heated soleplate, and steam chamber. In one instance, heel and toe lifting pistons are embedded in the soleplate and driven by an electric motor. A grip sensor in the handle triggers the lift piston motor to operate when the user is no longer gripping the handle. The lifting pistons are quickly retracted if the user grabs the handle again. The heated soleplate can be automatically turned off if the iron is left idle too long.

An advantage of the present invention is a clothes iron is provided that helps its users avoid damage to garments and work surfaces, and improves overall safety of use.

The above summary of the present invention is not intended to represent each disclosed embodiment, or every aspect, of the present invention. Other aspects and example embodiments are provided in the figures and the detailed description that follow.

BRIEF DESCRIPTION OF THE DRAWINGS

The present invention may be more completely understood in consideration of the following detailed description of various embodiments of the present invention in connection with the accompanying drawings, in which:

FIG. 2A shows the lifting legs retracted, and FIG. 2B shows them extended;

Figure 1:
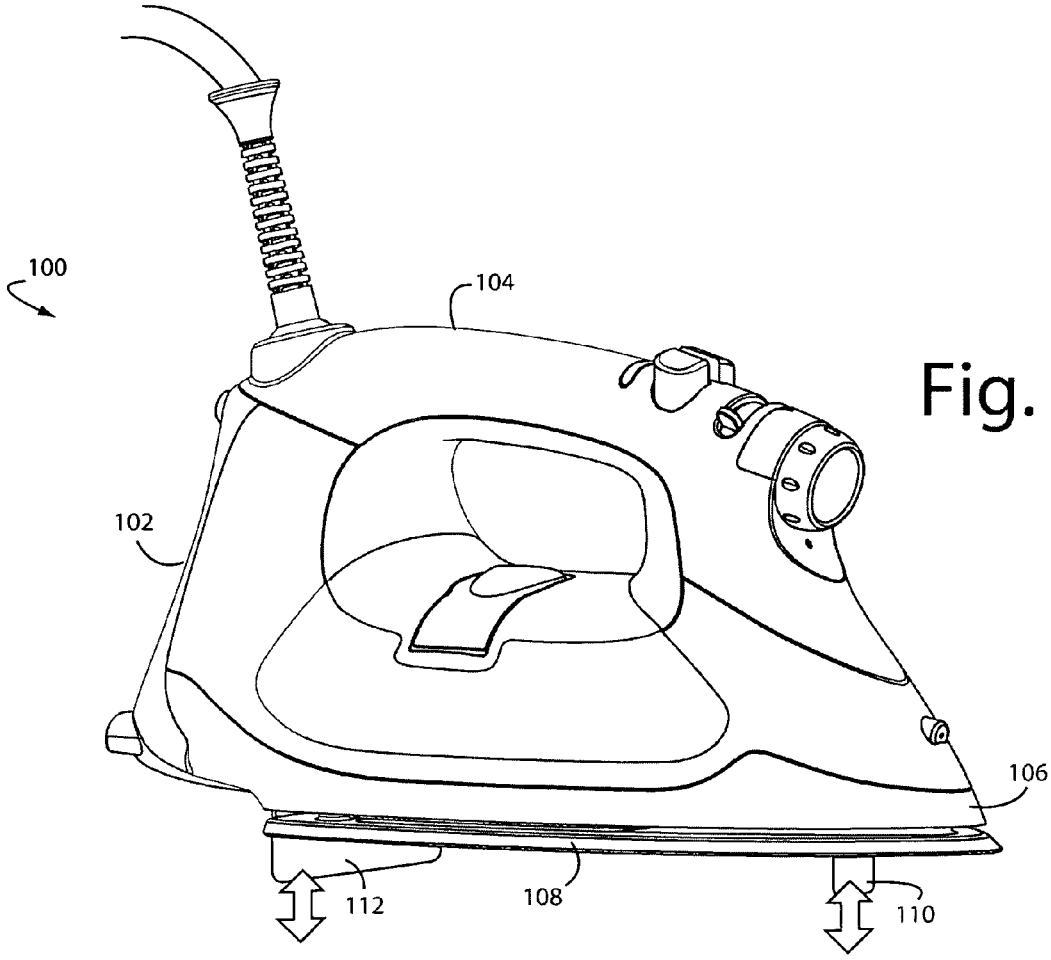
FIG. 1 is a perspective view diagram of an electric clothes iron embodiment of the present invention showing two self-lifting legs extended out through the base of soleplate.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention as defined by the appended claims.

DETAILED DESCRIPTION

The invention includes a clothes iron including features and advantages as described further below.

FIG. 1 represents an improved electric clothes iron embodiment of the present invention, and is referred to herein by the general reference numeral 100. The iron 100 comprises a housing 102, a handle 104 on top, a chassis 106, an electrically heated soleplate 108, and two legs 110 extending out through the base of the soleplate. Although the iron is shown with an electrical cord, the iron could also be cordless, using batteries for power.

Figure 2A:
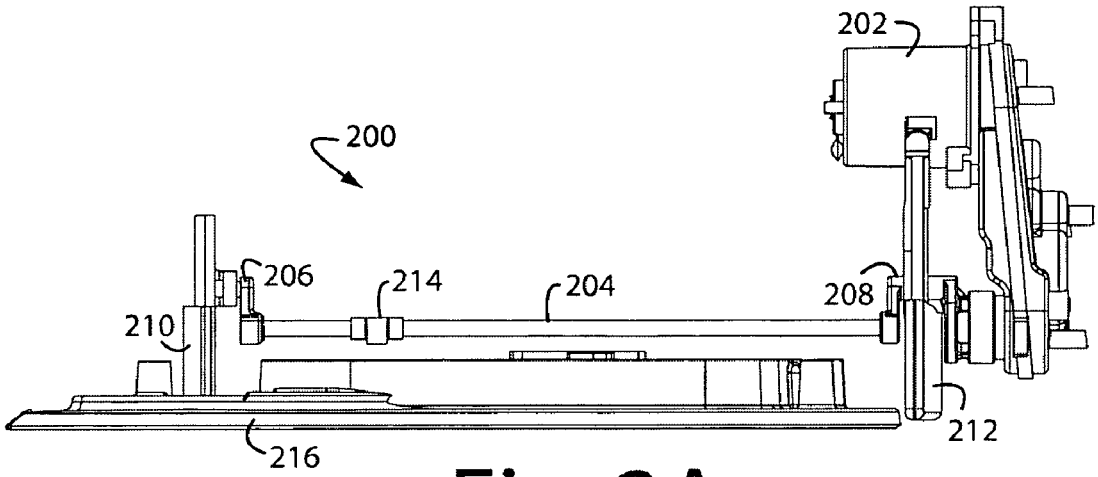
FIGS. 2A-2B are side view diagrams of an exemplary lifting mechanism used inside the iron of FIG. 1.
Figure 2B:
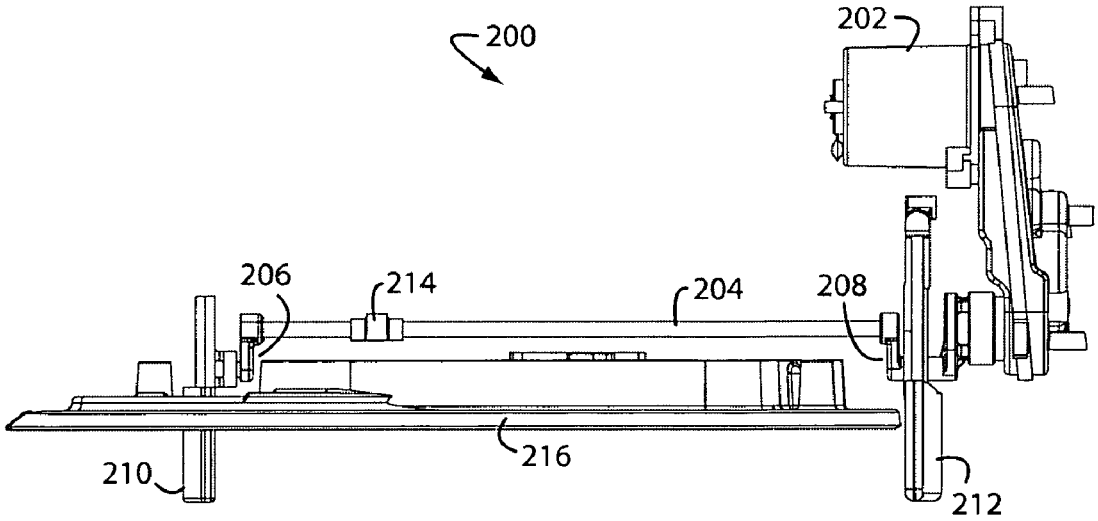

FIGS. 2A-2B represent a lifting mechanism 200 comprising a geared DC motor 202 mounted at the back, a driveshaft 204 that runs from the back to the front, lifting cams 206 and 208, legs 210 and 212, and a steam release cam 214. FIG. 2A shows the legs 210 and 212 when retracted up inside a heated soleplate 216, and FIG. 2B shows legs 210 and 212 extended out for lifting the iron up off the work surface.

Figure 2C:
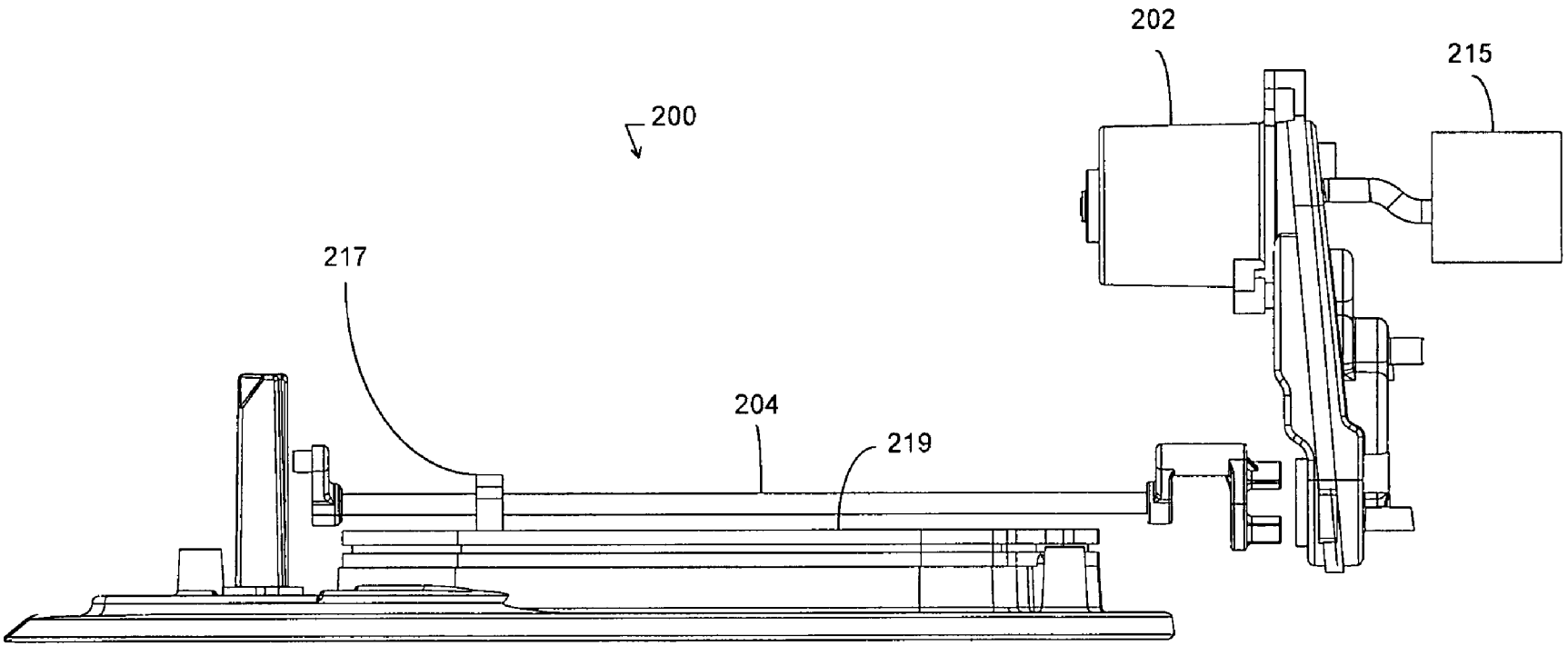
FIGS. 2C and 2D show an embodiments of the iron including apparatus for inhibiting mineral build-up in the steam chamber.

Most modern irons can produce steam. In some irons, mineral build up in the steam chamber and the apertures in the soleplate with which the steam is emitted onto the object to be ironed can experience mineral build up. In an alternate embodiment of the invention, the drive shaft 204 turns the cam 217. The motion of the cam 217 may be used to reduce such deposits, and or to prevent blockage of the steam apertures in the soleplate. FIG. 2C shows an embodiment of the invention including a silicone cap on a steam chamber. The cam 217 acts upon the silicone cap 219 to cause pressure changes that may inhibit mineral build up in the steam chamber or prevent blockage of the steam apertures in the soleplate.

Figure 2D:
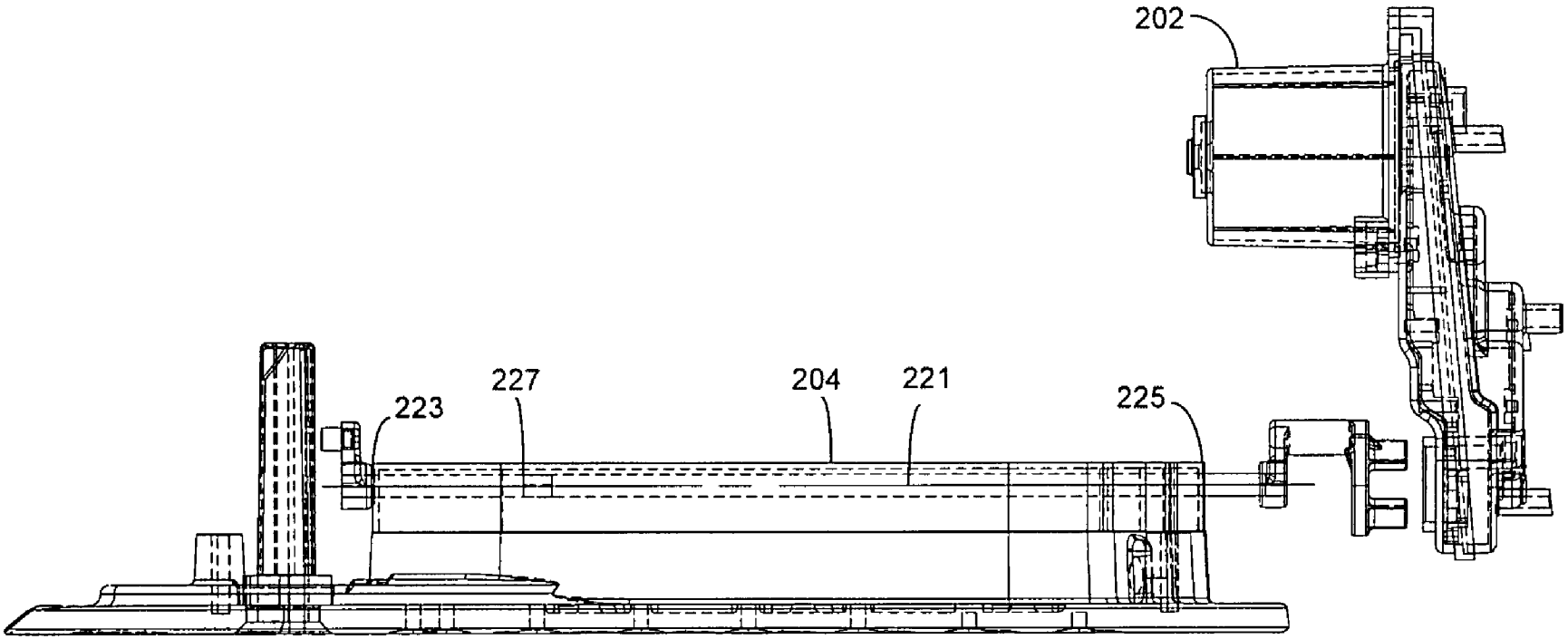

FIG. 2D shows another alternate embodiment for reducing mineral build-up in the steam chamber. In this embodiment, the drive shaft 204 extends through the steam chamber 227. Seals 223 and 225 on each end of the steam chamber 227 prevent steam from exiting along the drive shaft 204. Drive shaft 204 may include flanges or alternatively brushes 221 which agitate the water, or alternatively scrape the sides of the steam chamber 227 to prevent mineral build-up.

The legs may be limited to vertical motion by self-lubricating rails on the front foot and oil impregnated bushings on the rear foot. As the motor turns the shaft, the cams slide side-to-side in the slots while pushing the feet up or down. Such lifting mechanism improves over the prior art in that it does not interfere with conventional water tank, chassis, soleplate, or steam chamber configurations.

A leg position sensor can be used for detecting the lift height of the separation mechanism, and for using feedback to control a simple DC motor or other known actuation means to ensure exact extended or retraced position of the legs. When such feedback is not available, a more expensive stepper motor may be needed to be able to control the lift and lowering cycles. Such leg position feedback mechanism is an improvement over the prior art because it allows for a more accurate measurement of leg position. The iron can be placed in an energy saving mode if a microprocessor controller detects that the position of the legs have not changed for a selected period of time.

Figure 3A:
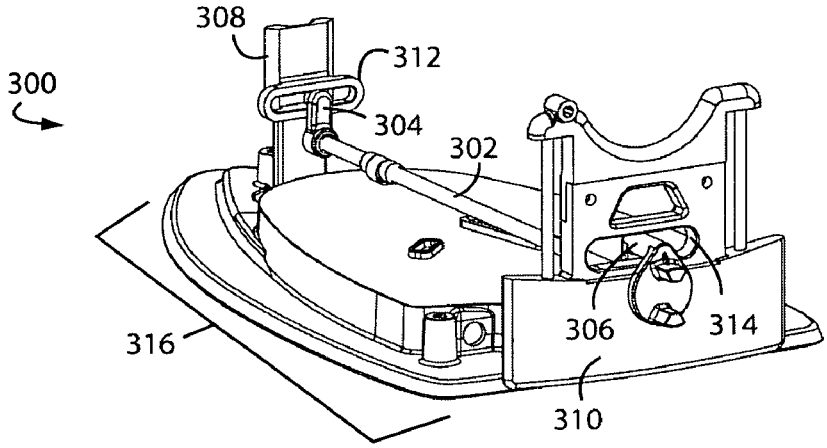
FIGS. 3A-3C are perspective view diagrams of a lifting mechanism drive shaft in three states: legs raised, legs extended, and intermediate.
Figure 3B:
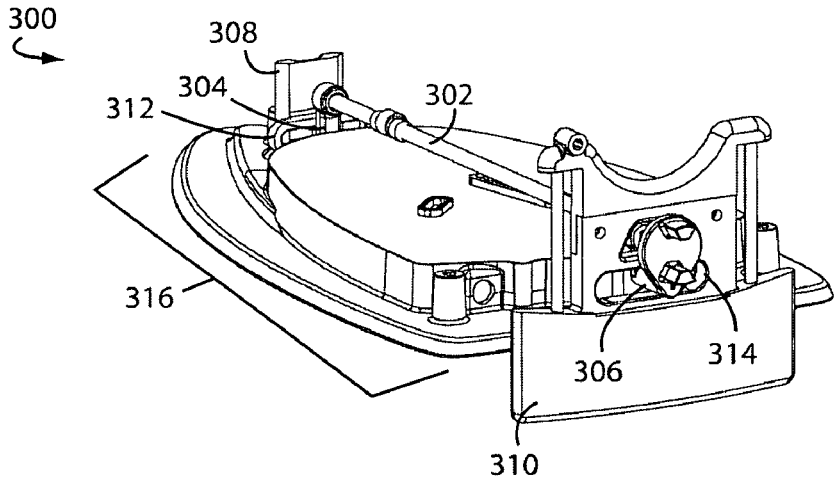
Figure 3C:
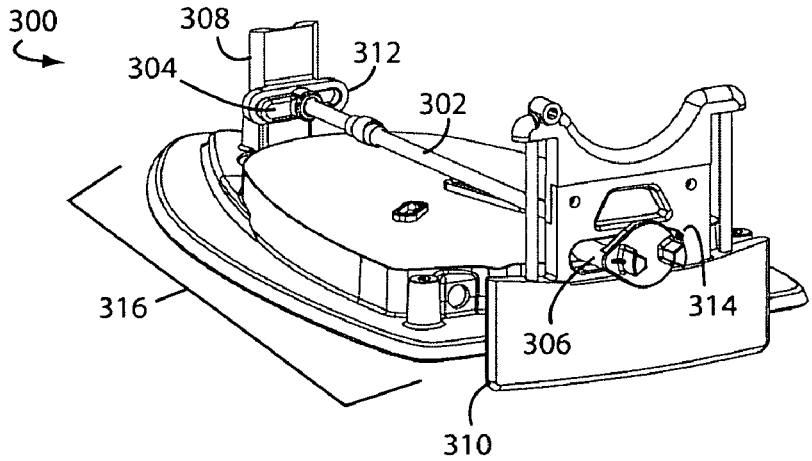

FIGS. 3A-3C represent a lifting mechanism 300 in three positions similar to that in FIGS. 2A-2B and useful in the iron of FIG. 1. The lifting mechanism 300 includes a crankshaft 302 connected by lifting cams 304 and 306 to a toe piston 308 and a wide heel piston 310. The ends of lifting cams oscillate in slots 312 and 314 and translate the crankshaft rotations into a vertical reciprocating motion for the lifting pistons. Any tendency for toe piston 304 to wobble may be limited by a guide rail mounted on chassis 316. Similarly, wobble for heel piston 310 may be limited by guide bushings.

FIGS. 3A-3C help illustrate the interaction of the crankshaft, lifting cams, pistons, and slots. FIG. 3A shows the pistons fully retracted, FIG. 3B shows them fully extended, and FIG. 3C shows the lifting mechanism in the intermediate halfway position.

Figure 4A:
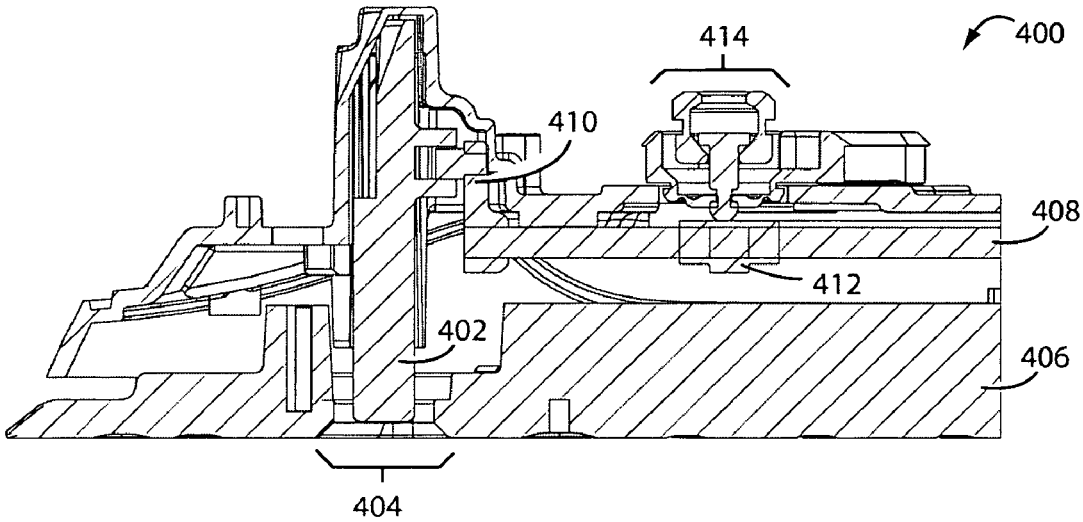
FIGS. 4A-4B show a cross-sectional view of a steam release cam and drip valve useful in the clothes iron of FIG. 1.
Figure 4B:
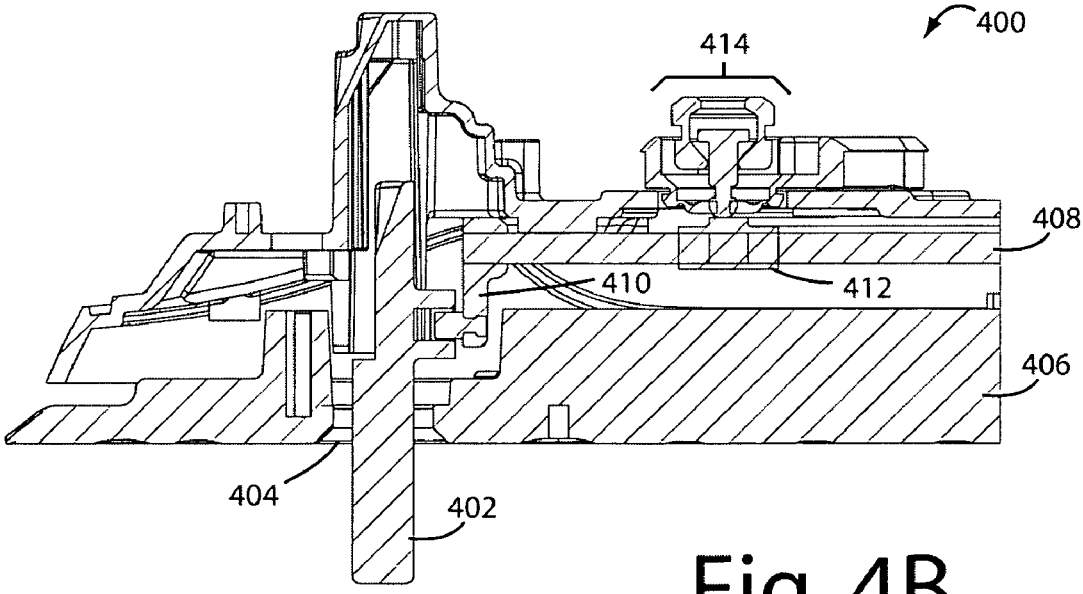

FIGS. 4A-4B illustrate a steam control subsystem 400. Steam is only allowed when a lifting toe piston 402 is fully retracted into its beveled recess 404, as in FIG. 4A. Heat from a heated soleplate 406 is isolated from the toe piston 402 so the end of the toe piston will not burn the working surface the iron may be laid upon when the iron lifts up. A crankshaft 408 is driven by an inexpensive motor and turns both a piston lift cam 410 and a steam control cam 412. A steam valve 414 is only opened when the steam control cam 412 is rotated straight up, corresponding with the piston lifting cam 410 being straight up too. The toe piston 402 is in its fully retracted position and the iron is ready for work.

FIG. 4B shows crankshaft 408 rotated 180-degrees from that shown in FIG. 4A. The toe piston 402 is fully extended, and steam control cam 412 has allowed steam valve 414 to close.

Figure 5:
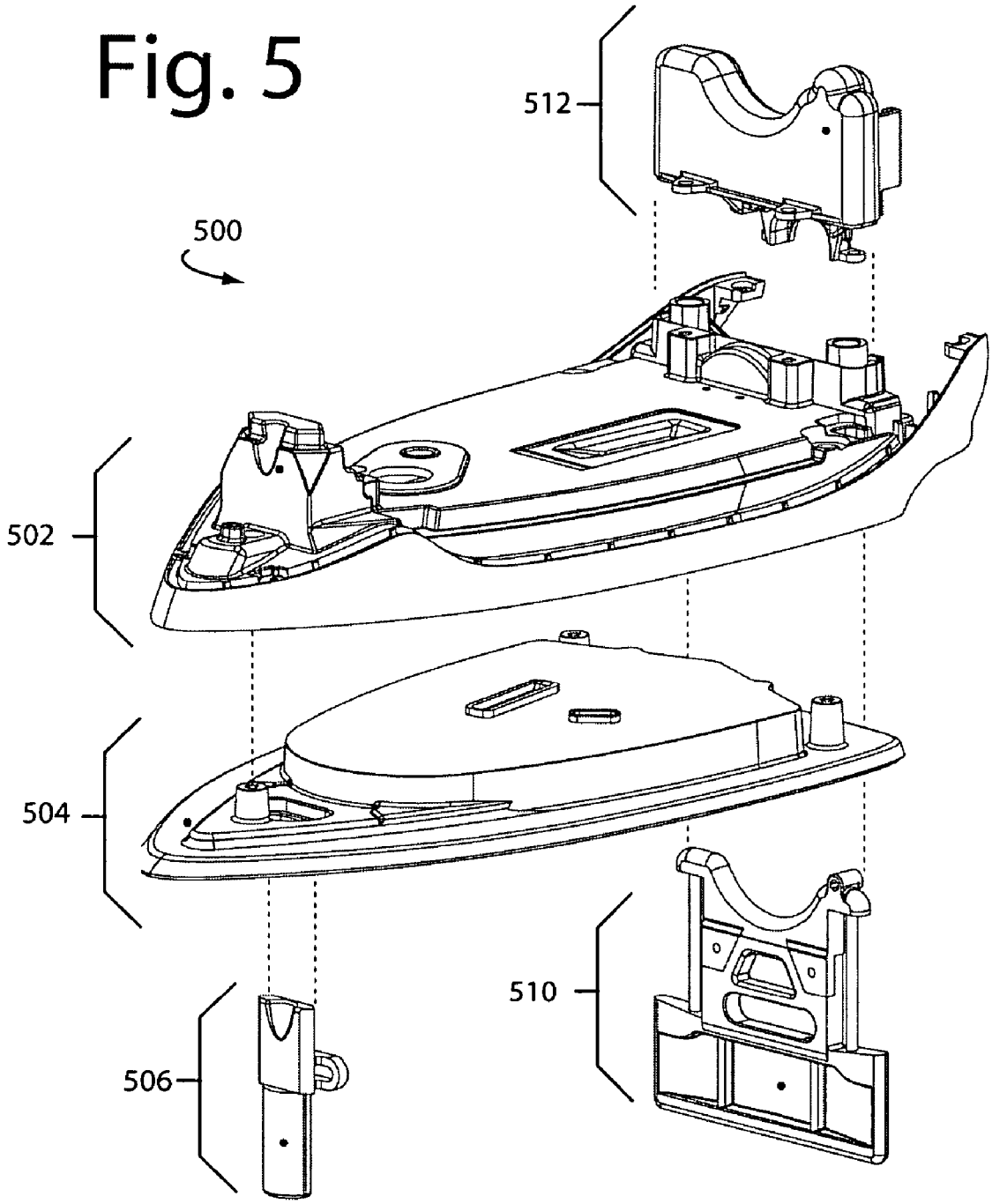
FIG. 5 is an exploded assembly view of a clothes iron subassembly useful in the iron of FIG. 1.

FIG. 5 shows an iron subassembly 500 comprising a chassis 502, a heated soleplate 504, a toe piston 506, a toe cavity 508, a heel piston 510, and a heel piston sealing cover 512. The chassis 502 is molded so that toe cavity completely covers toe piston 506 and blocks any steam or water from coming back up from the working surface into the iron's interior. Similarly, the heel piston sealing cover 512 keeps moisture from getting past it into the interior electrical circuits where the dampness could cause trouble.

Figure 6:
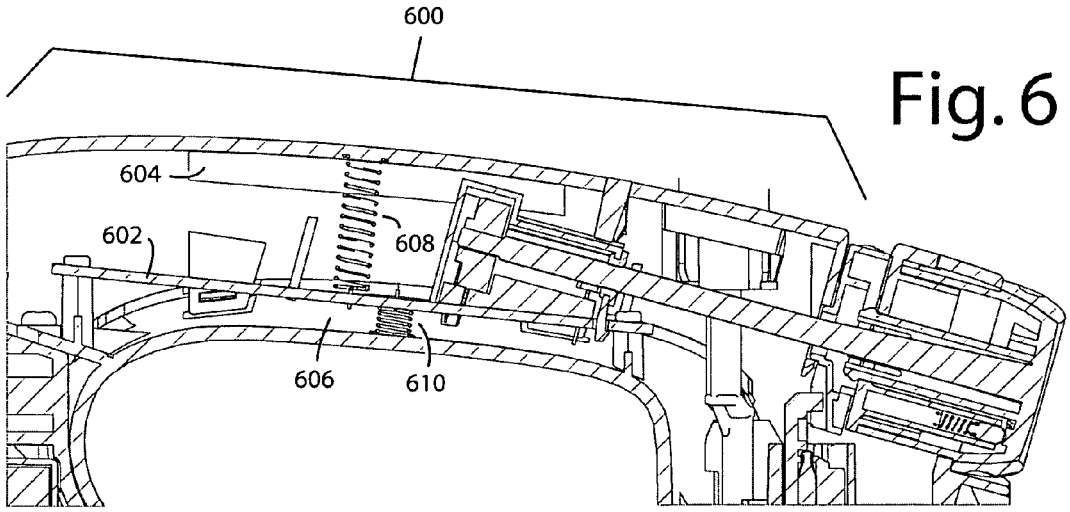
FIG. 6 is a partial cutaway diagram of a handle for the iron of FIG. 1 and includes capacitive sensors to detect a user's grip.

Generally the iron is activated by a sensor which detects when the operator touches or grasps the handle of the iron. However, the sensor could also detect the proximity of the user or the user's hand, and in still other embodiments, the sensor might take the form of a manually operated switch activated by the user. FIG. 6 shows a partial cutaway of a handle 600 with a capacitive touch sensor circuit 602. A pair of capacitor electrodes 604 and 606 comprise conductive coatings or tape inside a hollow plastic handle core. Circuit 602 contacts these electrodes through a pair of contact springs 608 and 610. It senses when a user grips the handle, and a microprocessor may be used to interpret the signals and control the lifting mechanisms.

Figure 7:
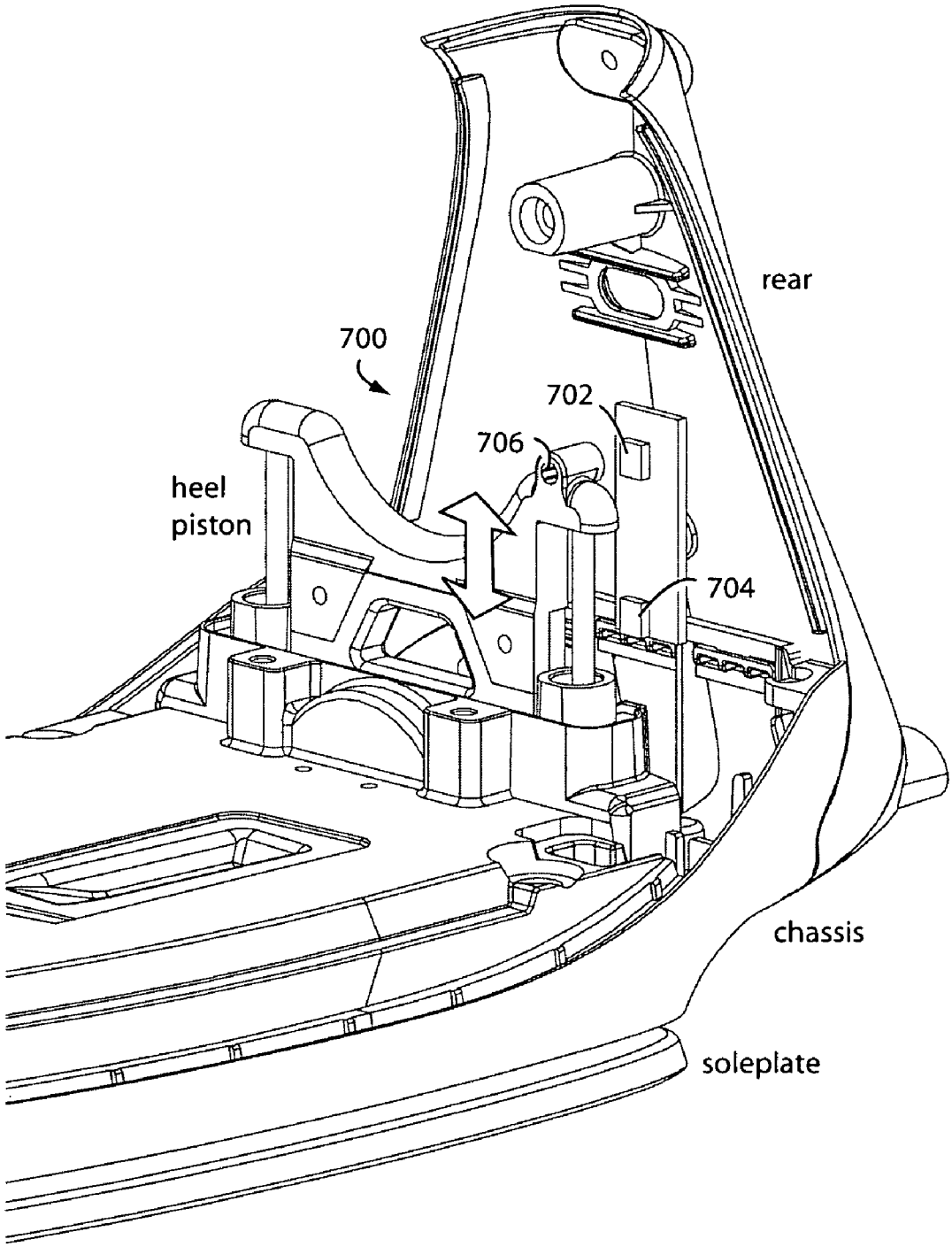
FIG. 7 is a partial cutaway of the rear of a clothes iron embodiment which details a leg position sensor assembly.

FIG. 7 represents a leg position sensor 700 disposed in the rear interior of an iron like that of FIG. 1. Two Hall effect sensors 702 and 704 measure their positions relative to a heel piston magnet 706. Any of a large number of conventional position sensing technologies could be used instead, what's illustrated here is merely an example of one practical way to implement such sensor.

Figure 8:
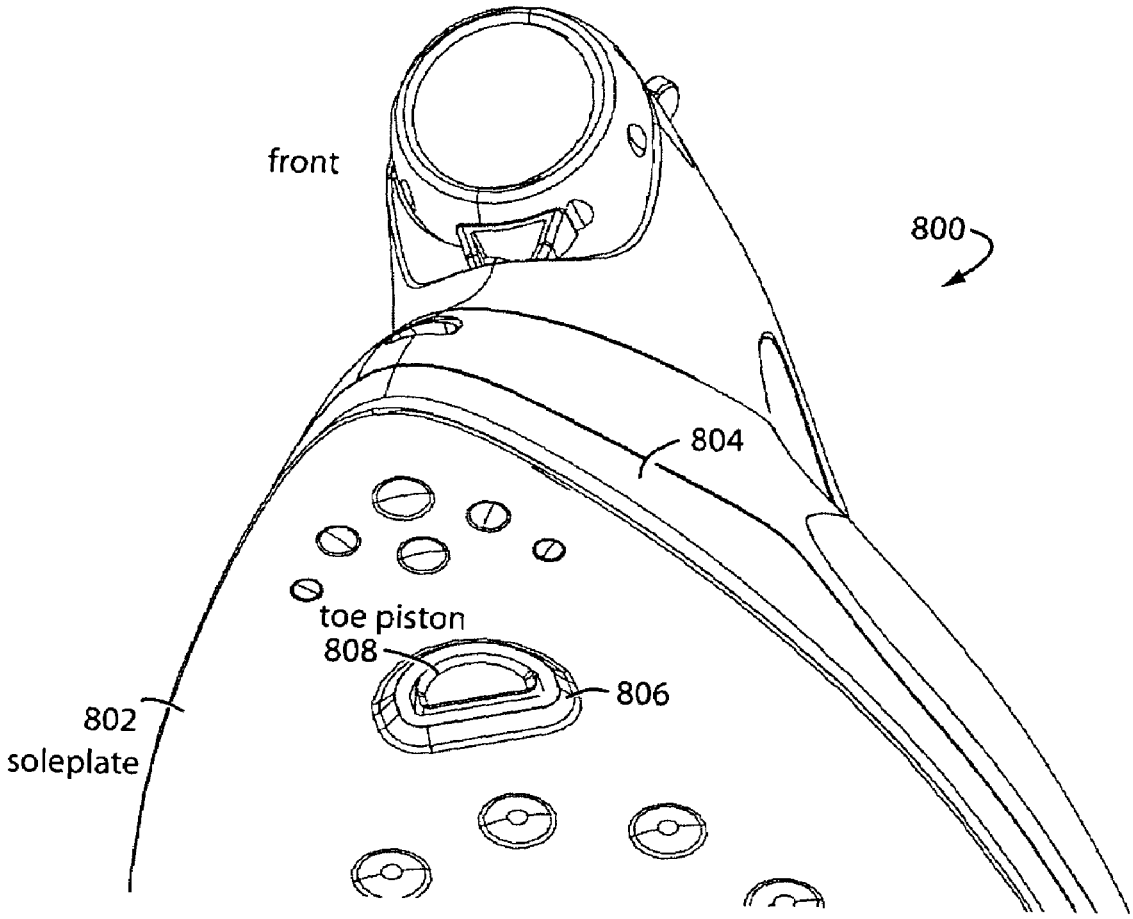
FIG. 8 is a bottom perspective view of a clothes iron with the toe piston fully retracted.

FIG. 8 represents a front lift mechanism 800 embedded in a heated soleplate 802 and mounted to a chassis 804. A heat insulator 806 comes between a toe piston 808 and the heat generated in soleplate 802. Such heat insulator 806 can either be mounted to the soleplate 802 or the toe piston 808.

Figure 9:
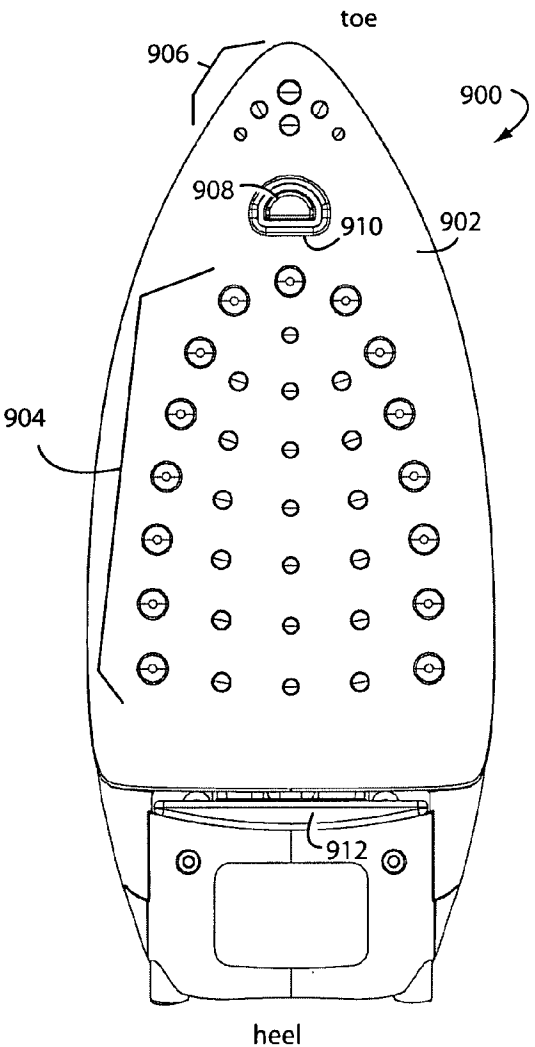
FIG. 9 is a bottom view of an iron showing the semicircular shapes of the feet which reduce the contact area between the feet and the fabric when the legs are extended.

FIG. 9 represents a clothes iron embodiment of the present invention and is referred to herein by the general reference numeral 900. Viewed from the bottom, a soleplate 902 has dozens of steam vents in two groups 904 and 906. Semicircular shapes for toe piston 908 and heel piston 912 reduce the contact area with the fabric when the legs are extended. This minimizes any indentation created by the feet on the fabric.

Figure 10:
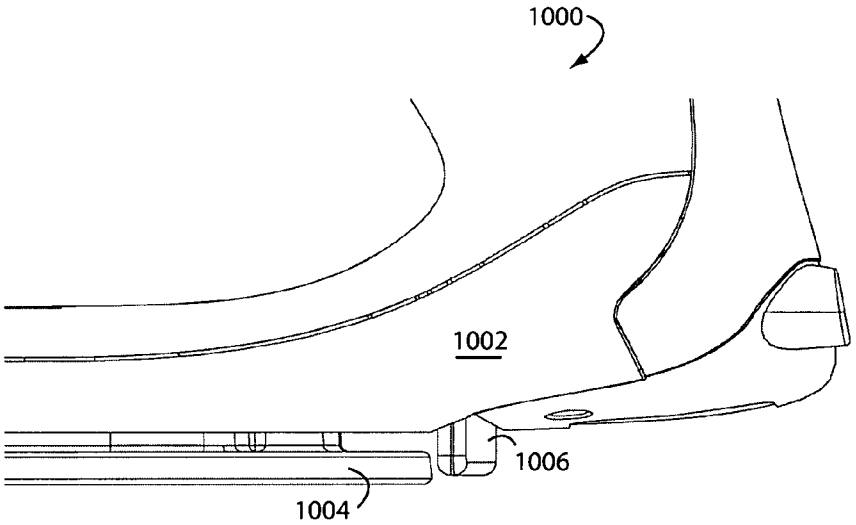
FIG. 10 is a side view diagram of a soleplate and legs when the feet are fully retracted.

FIG. 10 represents an iron 1000 with a chassis 1002 that supports a soleplate 104 and a heel piston 1006. Since this is a side view, the gap between heel piston 1006 and soleplate 1004 can be readily seen. The heel piston 1006 is in its fully retracted position.

Figure 11A:
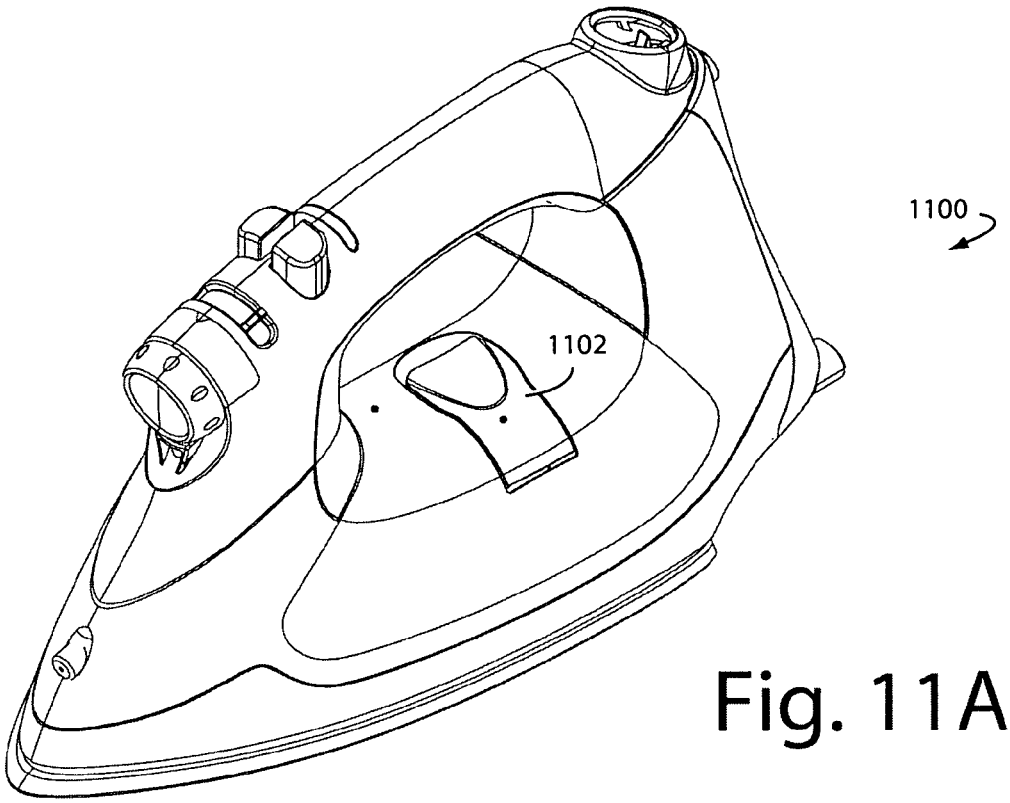
FIGS. 11A-11B are perspective views of a clothes iron with a fill port open (FIG. 11A) and closed (FIG. 11B)
Figure 11B:
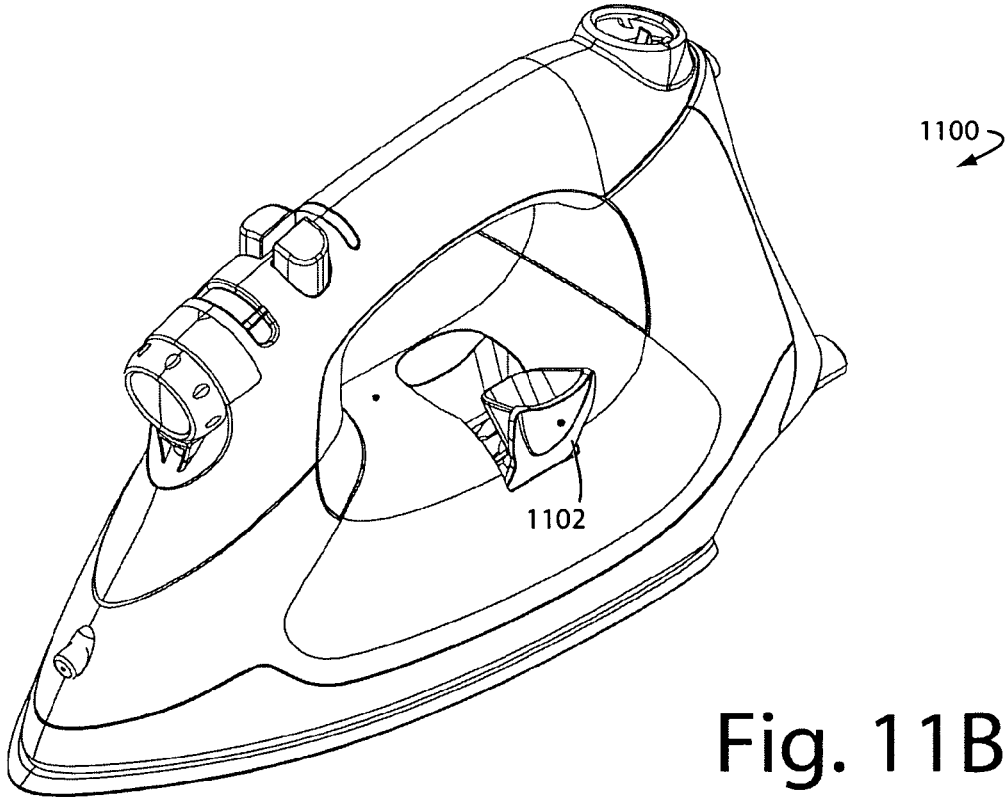
Figure 11C:
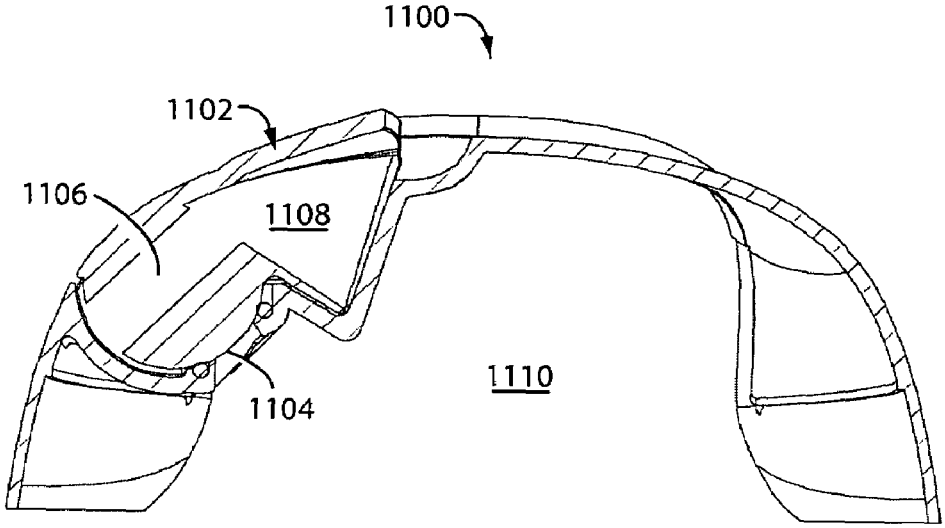
FIGS. 11C-11D are cross-section views of the fill port of FIGS. 11A-11B.
Figure 11D:
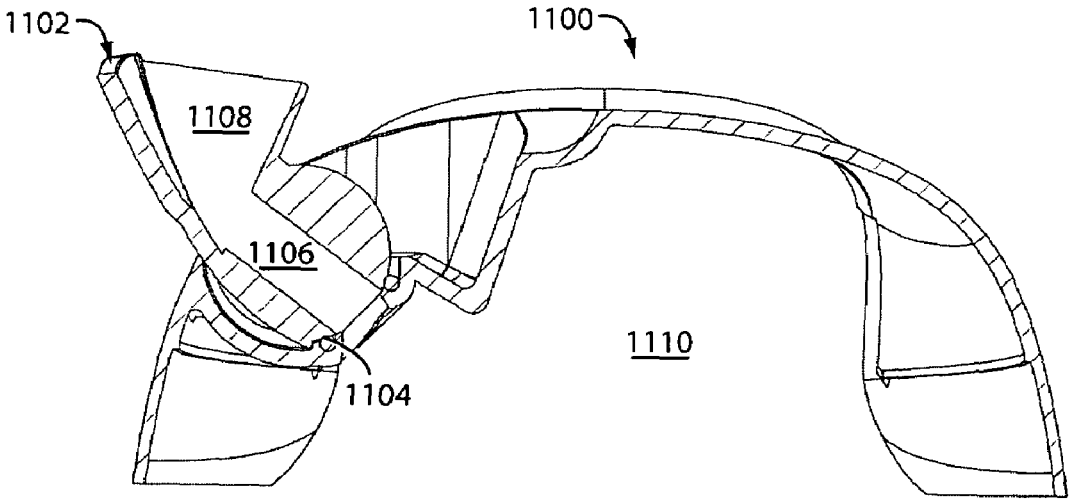

FIGS. 11A-11B show a clothes iron 1100 with a fill port 1102 open in FIG. 11A, and closed in FIG. 11B. FIGS. 11C-11D provide more detail. As seen here in cross-section, fill port 1102 includes a large ball joint 1104 with a conduit 1106 and a funnel section 1108 that receive water for a reservoir tank 1110. The tank 1110 is sealed off when the fill port 1102 is in the closed position of FIG. 11C. In FIG. 11D, the fill port 1102 has been flipped open, and a direct path for fill water leads from funnel section 1108 to conduit 1106 to tank 1110. When full, the fill port 1102 is flipped back into the housing. After ironing, the user can drain any remaining water from the clothes iron by tilting it forward and pouring out the water through a drain port located on the front of the handle.

Figure 12A:
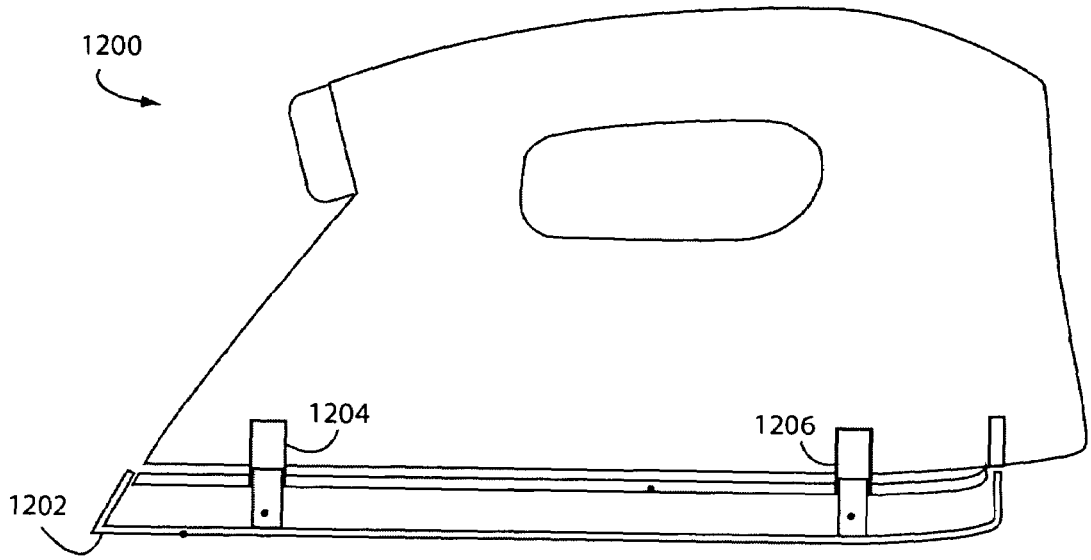
FIGS. 12A-12B show an alternate embodiment of the present invention with a low thermal mass separation sheet.
Figure 12B:
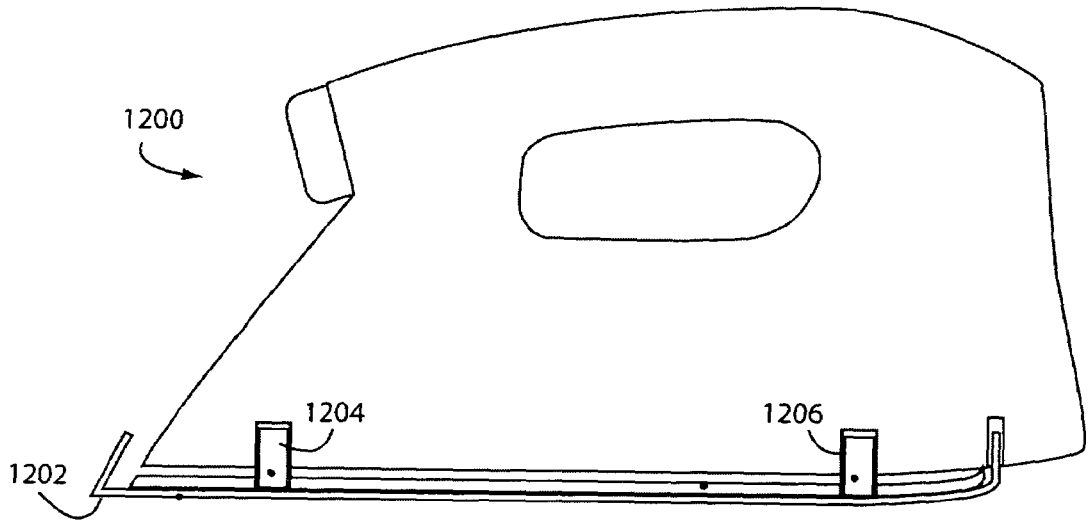

Another basic embodiment of a clothes iron embodiment of the present invention is shown in FIGS. 12A-12B. An improved clothes iron 1200 is provided with a low thermal mass separation sheet 1202. Such separation sheet cools off very quickly when not in intimate contact with a heating plate 1204, as in FIG. 12A. A pair of pistons 1206 and 1208 control whether separation sheet 1202 should contact the heating plate 1204, as in FIG. 12B.

Figure 13A:
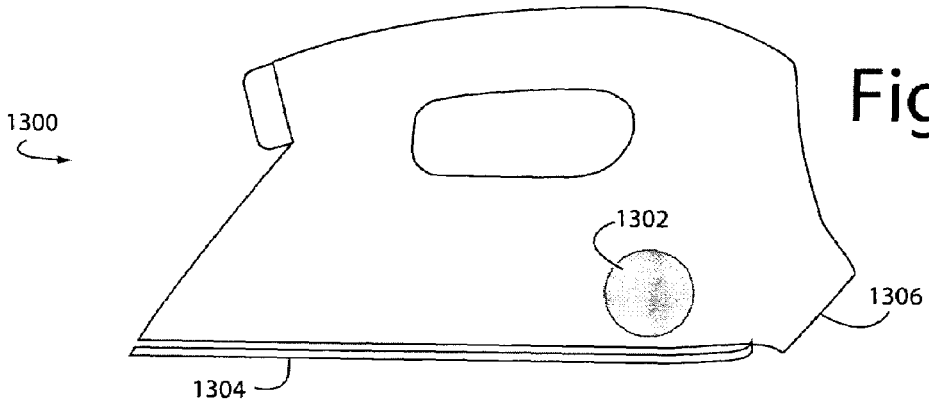
FIG. 13A-13B show an alternate embodiment of the present invention in which separation of the soleplate and the ironing surface is accomplished by means of a weight shift.
Figure 13B:
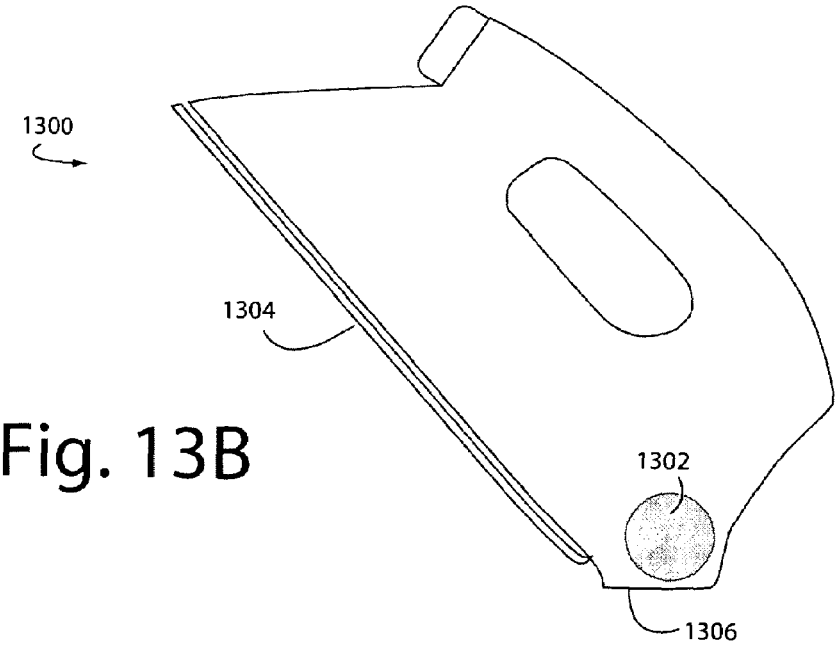

FIG. 13A-13B show another clothes iron embodiment of the present invention, and is referred to herein by the general reference numeral 1300. When a weight 1302 is positioned forward, as in FIG. 13A, the iron 1300 will naturally rest on its bottom ironing surface 1304. If the iron 1300 is left in this position unattended too long when powered on, then a motor is used to move the weight 1302 far to the rear. The change in the center of gravity causes the iron to rock back and stand on a heel plate 1306, as in FIG. 13B.

Figure 14A:
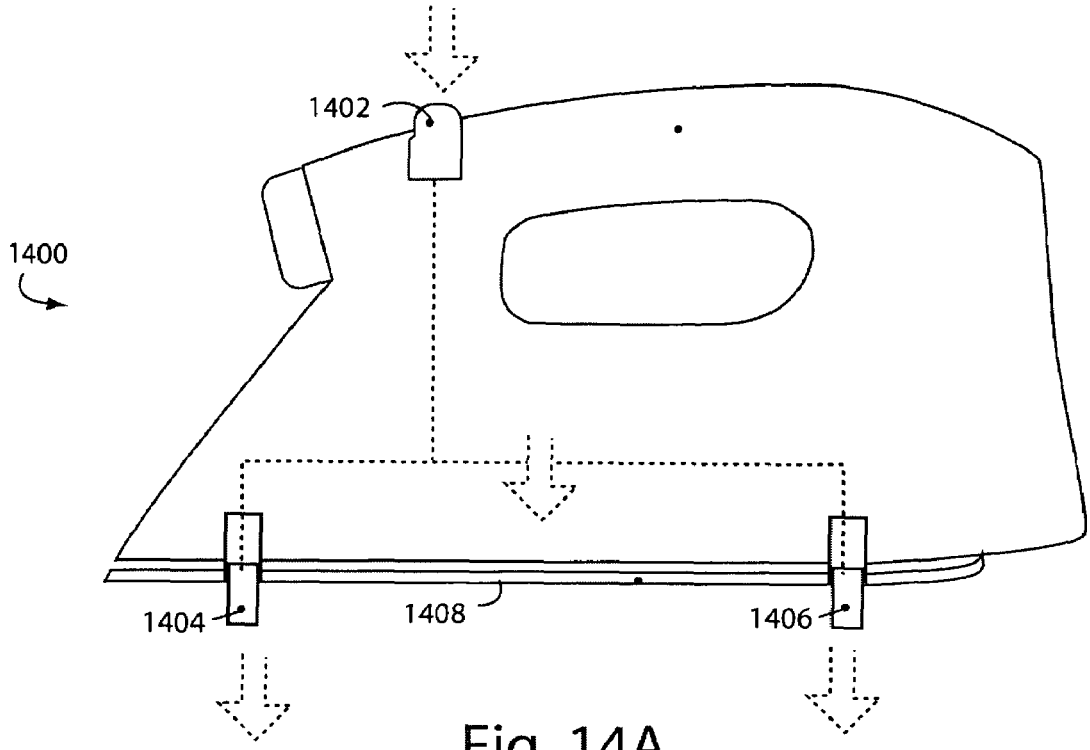
FIGS. 14A-14B show another embodiment of the present invention whereby separation of the soleplate and the ironing surface is accomplished by means of a user pressing down on button.
Figure 14B:
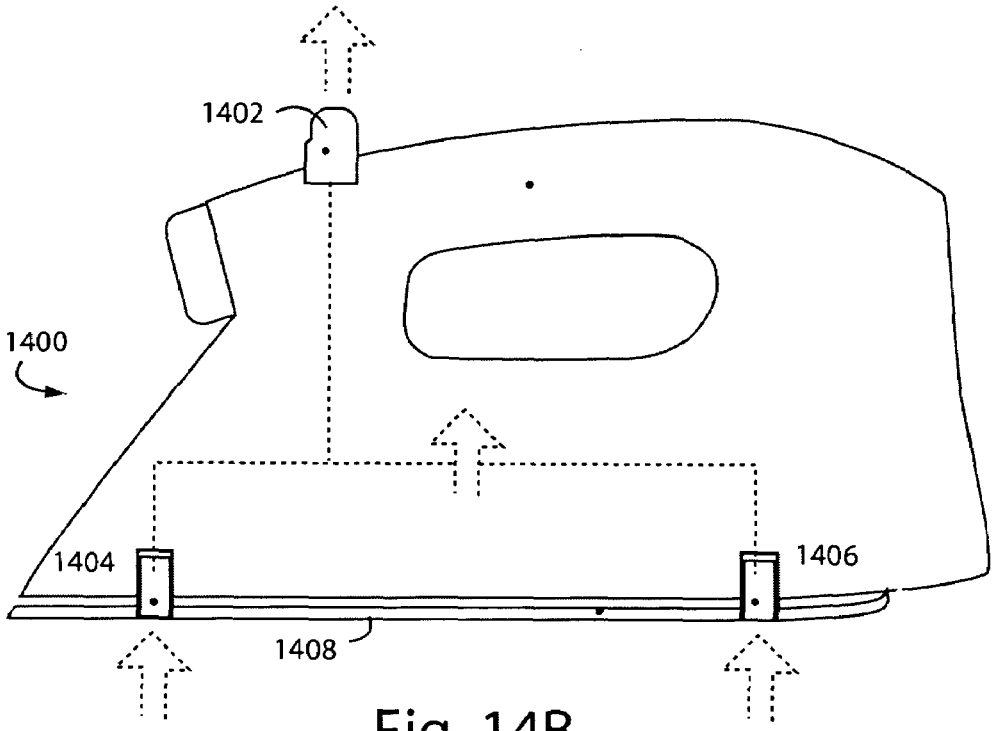

A still further clothes iron embodiment of the present invention is represented in FIGS. 14A-14B, and is referred to herein by the general reference numeral 1400. Iron 1400 has a highly simplified lifting mechanism. A simple button 1402 is pressed down and a linkage causes front and rear legs 1404 and 1406 to emerge from a soleplate 1408, as in FIG. 14A. The button 1402 is pressed again to release a lock and legs 1404 and 1406 are retracted back into soleplate 1408.

Figure 15A:
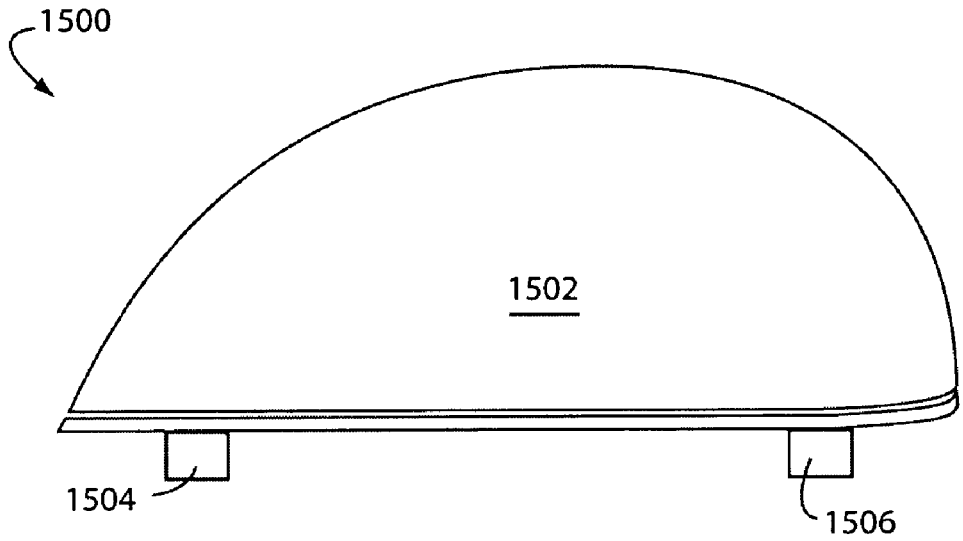
FIGS. 15A-15B show an alternative embodiment of the present invention that has no handle.
Figure 15B:
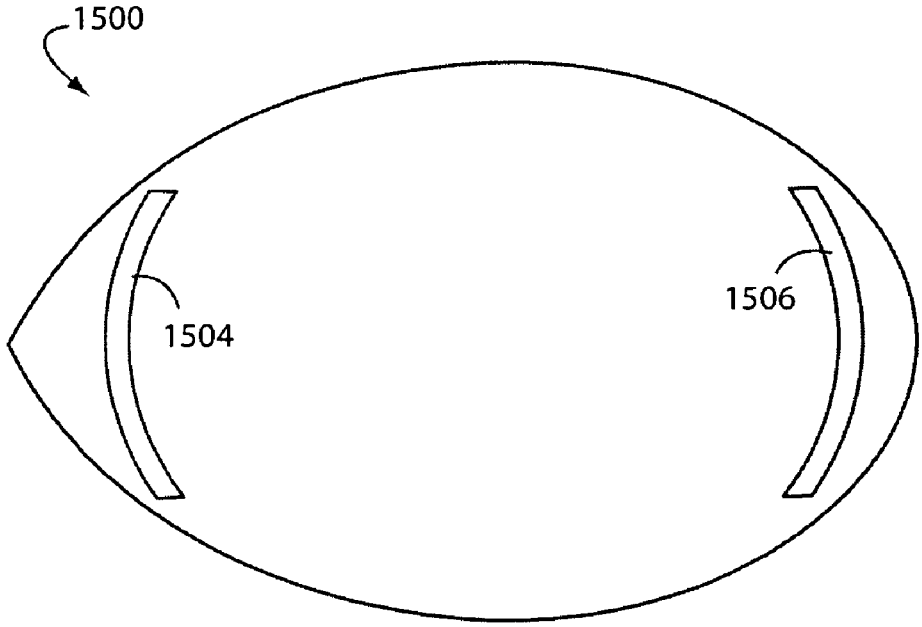

FIGS. 15A-15B show an alternative clothes iron embodiment of the present invention that has no handle, and is referred to herein by the general reference numeral 1500. A housing 1502 is designed to fit into the palm of a user's hand. A separation mechanism 1504 and 1506 does not require the user to lift the iron, so it is possible to eliminate the conventional iron handle and only have a rounded top surface. This creates a more multidirectional iron, allowing the iron to be more circular and allowing the user to grip the iron in any orientation.

Figure 16A:
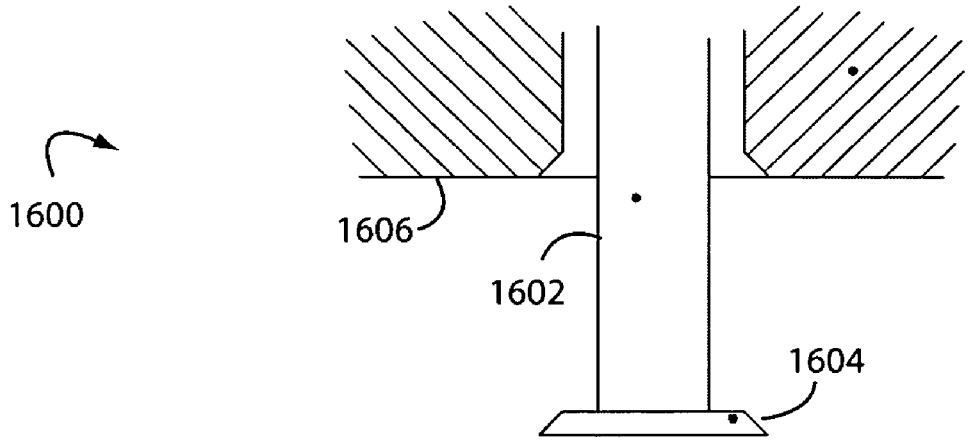
FIGS. 16A-16B show an alternative leg construction with a low thermal mass layer on the bottom.
Figure 16B:
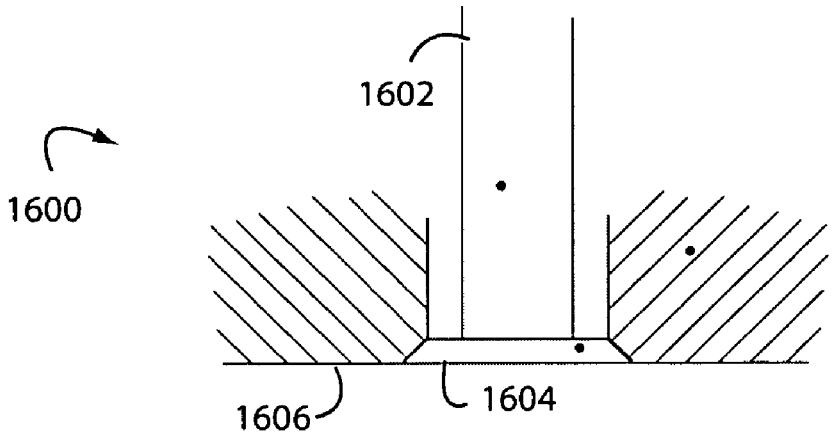

FIGS. 16A-16B show an alternative lifting mechanism leg construction 1600. In FIG. 16A a leg 1602 is extended. A pad 1604 is attached at the distal end and is constructed of a material with a low thermal mass. FIG. 16B shows leg 1604 retracted, and the pad 1604 closes contact with an iron soleplate 1606. When the separation mechanism lowers the iron to the ironing surface, the pad 1604 will heat up quickly to the soleplate temperature, providing a smooth, continuous heated surface. When the separation mechanism raises the iron, the pad 1604 will quickly cool to room temperature.

Figure 17:
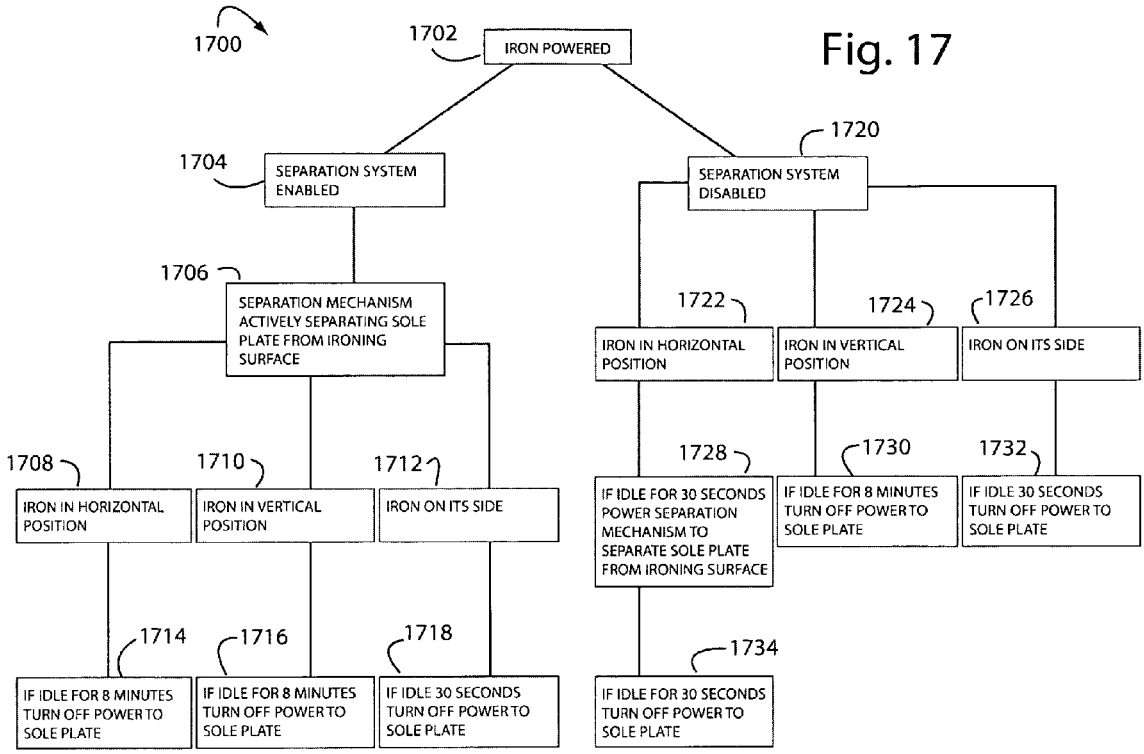
FIG. 17 is a flowchart diagram of a control process for the iron of FIG. 1.

A clothes iron control process embodiment of the present invention is diagrammed in FIG. 17, and is referred to herein by the general reference numeral 1700. Process 1700 begins with a step 1702 when the iron is powered. If the separation or lifting mechanism is enabled, control passes to a step 1704. A sensor is read to see if the iron is horizontal, vertical, or on its side. If horizontal, flat on its bottom, a step 1708 starts an eight minute timer. If vertical, standing up on its heel a step 1710 starts an eight minute timer. If on its side, a step 1712 starts a thirty second timer. If the iron is idle and horizontal for too long, a step 1714 turns off the heated soleplate. If the iron is idle and vertical for too long, a step 1716 turns off the heated soleplate. If the iron is idle and on its side for longer than thirty seconds, a step 1716 turns off power to the heated soleplate.

If the separation or lifting mechanism is disabled, control passes to a step 1720. A sensor is read to see if the iron is horizontal, vertical, or on its side. If horizontal, flat on its bottom, a step 1722 starts a thirty second timer. If vertical, standing up on its heel a step 1724 starts an eight minute timer. If on its side, a step 1726 starts a thirty second timer. If the iron is idle and horizontal for too long, a step 1728 activates the lifting mechanism. If the iron is idle and vertical for too long, a step 1730 turns off the heated soleplate. If the iron is idle and on its side for longer than thirty seconds, a step 1732 turns off power to the heated soleplate. If after lifting and separating in step 1728, thirty seconds more has elapsed and the iron has been idle, then a step 1734 turns off power to the soleplate.

Figure 18A:
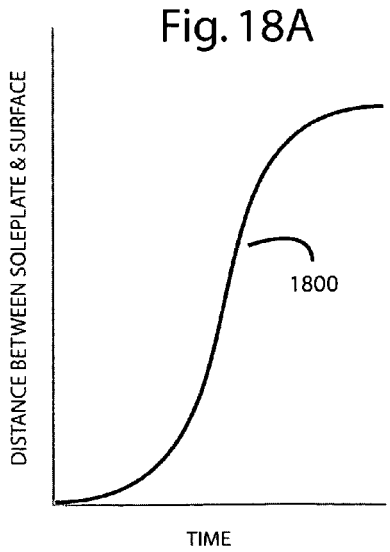
FIGS. 18A and 18B diagram the way the lifting mechanisms accelerate and decelerate during their operation.
Figure 18B:
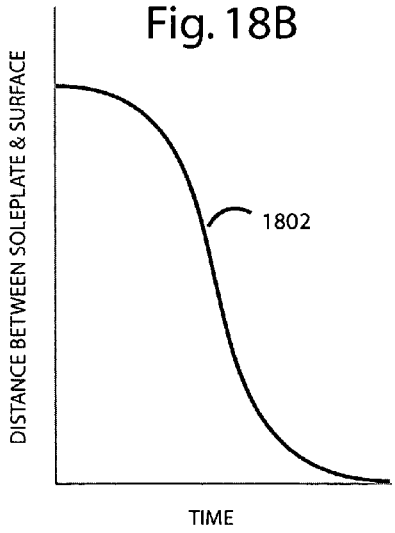

FIGS. 18A-18B represent the speed at which the lifting and separating mechanisms operate over time and separation distance. A lifting curve 1800 begins slowly and gains speed, it decelerates at the end of the lift. Similarly, a retraction curve 1802 descends slowly at first, then drops more rapidly, and finishes with a slow careful landing.

In general, the separation mechanism when activated should minimize any indentations that will be left in the fabrics of the clothes being ironed. Ideally, the shape of the area itself in contact with the fabric should be reduced while still allowing for stability. The separation mechanism should not catch or bind on fabrics when the iron is in use. And if the iron were tilted slightly to one side, the iron should be able to right itself automatically. Half circle leg ends can provide maximum stability with minimal contact area. Recesses in the soleplate help reduce snagging when the legs are retracted deeper into the soleplate.

Separation mechanism pieces that operate through ports in the soleplate must be insulated from the heated parts so they will not burn the fabric or work surfaces when the irons lifts off. High-temperature plastics or ceramics are insulated from the soleplate wherever they pass through. If the distal tip of the lifting legs are made of low thermal mass and highly heat conductive materials, then when retracted they could help spread working heat across the lifting port openings for more uniform ironing. Such would cool quickly to room temperature when the separation device was activated to separate the iron from the ironing surface. The advantage of this configuration would be that the separation device if going through the soleplate would not create cold spots.

In one embodiment, a front leg passes through a sleeve of insulating material connected to the chassis. Or the sleeve could be attached to the leg as an integrated layer of insulation. The rear leg is placed aft of the hot soleplate, and the air gap between the leg and the soleplate acts as the insulator.

Steam and moisture must be prevented from backing up through any ports provided in the soleplate for the lifting mechanism. Such unwanted steam and moisture inside the iron can damage the interior parts, and short out the electronics. A physical barrier between the lifting mechanism and other sensitive iron components is a good way to prevent such problems. The steam chamber is very difficult to seal, so the best lifting mechanism implementations will not require modifications to conventional steam chambers.

The chassis should be implemented such that it completely seals over the top of the front foot. A secondary cover over the back foot is used to seal it. These covers should completely encase both feet, and work as a barrier between the steam and the internal parts of the iron. Both the front and back feet are placed just outside dimensions of the steam chamber, so the steam chamber volume can be maximized and uninterrupted.

Embodiments of the present invention generate steam when in the horizontal lifted position. Conventional irons use gravity to control steam generation and a passive steam valve. When a conventional iron is horizontal, the water in the tank is allowed to drip down onto the hot soleplate, creating steam. In the vertical position, the supply water is prevented from dripping down, so the steam will deplete. But because steam iron embodiments of the present invention always remain horizontal, it is advantageous to have an active steam valve to turn the steam on only when the user wishes to iron. This can be accomplished using the separation mechanism movement, a valve that is directly controlled by the microprocessor, a switch activated by the users touch, or a mechanical connection between the user's hand and the valve.

In one embodiment, cams mounted on the separation mechanism shaft are used to open and close drip valves and therefore the amount of steam produced. The cams are aligned so that the drip valves are open only when the feet are retracted. Alternative methods include a valve driven by a motor independent of the leg actuating motor, or a valve mechanically opened and closed by a button or mechanical lever on the outside of the iron. An active steam valve in an iron can be used to regulate when steam is available, e.g., to use make steam in a vertical position to steam hanging clothes.

Under normal use, iron embodiments of the present invention do not need to stand vertically. So the water filling port can be placed on the side or the top of the housing so the user can fill the iron while it was standing in the horizontal position on its legs. A ball-joint and o-ring system is used to create a water tight seal when the fill port is flipped closed. A side-located fill port allows the iron to be filled in any sink, not just ones with high faucets as needed by conventional irons. Since the fill port is not confined to the handle, as on existing irons, a wide built-in funnel can be included.

There are cases when users would wish to disable the separation mechanism entirely. A means, such as a switch, can be provided to allow the user this option.

The back end can be configured to allow the iron to rest in the vertical position, a sensor keeps the legs retracted. The controller can override this if it detects that the iron has not been used in an extended period of time, e.g., to extend the legs to ensure that the fabric or ironing surface is not burned.

If the iron is left unattended too long in any position, it is advantageous that the iron shut off the heating element after a specified period of inactivity in order to conserve energy and prevent potential hazards resulting from the hot soleplate.

Any embodiment can use position sensors in the legs to determine whether the legs have been extended for a specified period of time, indicating that the iron is not being used. After the specified period of time, the microprocessor cuts power to the heating element. The next time the iron lowers itself, the microprocessor turns the heating element back on. In the case that the user has activated the separation override switch, the iron will rise itself from the iron surface and cut the power to the heating element if left inactive for a period of time. Also iron orientation sensors detect whether the iron has been left vertical for an extended period of time or has been knocked over and will turn off power to the heating element accordingly.

A motorized shaft also offers opportunities to enhance the steam capabilities of the iron. In addition to retracting the legs and opening the valves, the shaft could also be used to pressurize the steam burst, e.g., using a bellows system to pressurize the water before entering the soleplate. The result would be a spray of water that is rapidly vaporized, generating a much stronger steam burst.

One alternative embodiment uses no handle. The iron housing is designed to fit into the palm of the user's hand. The separation mechanism does not require the user to ever lift the iron, it is possible to eliminate the handle and only have a rounded top surface. This creates a more multidirectional iron.

Figure 19:
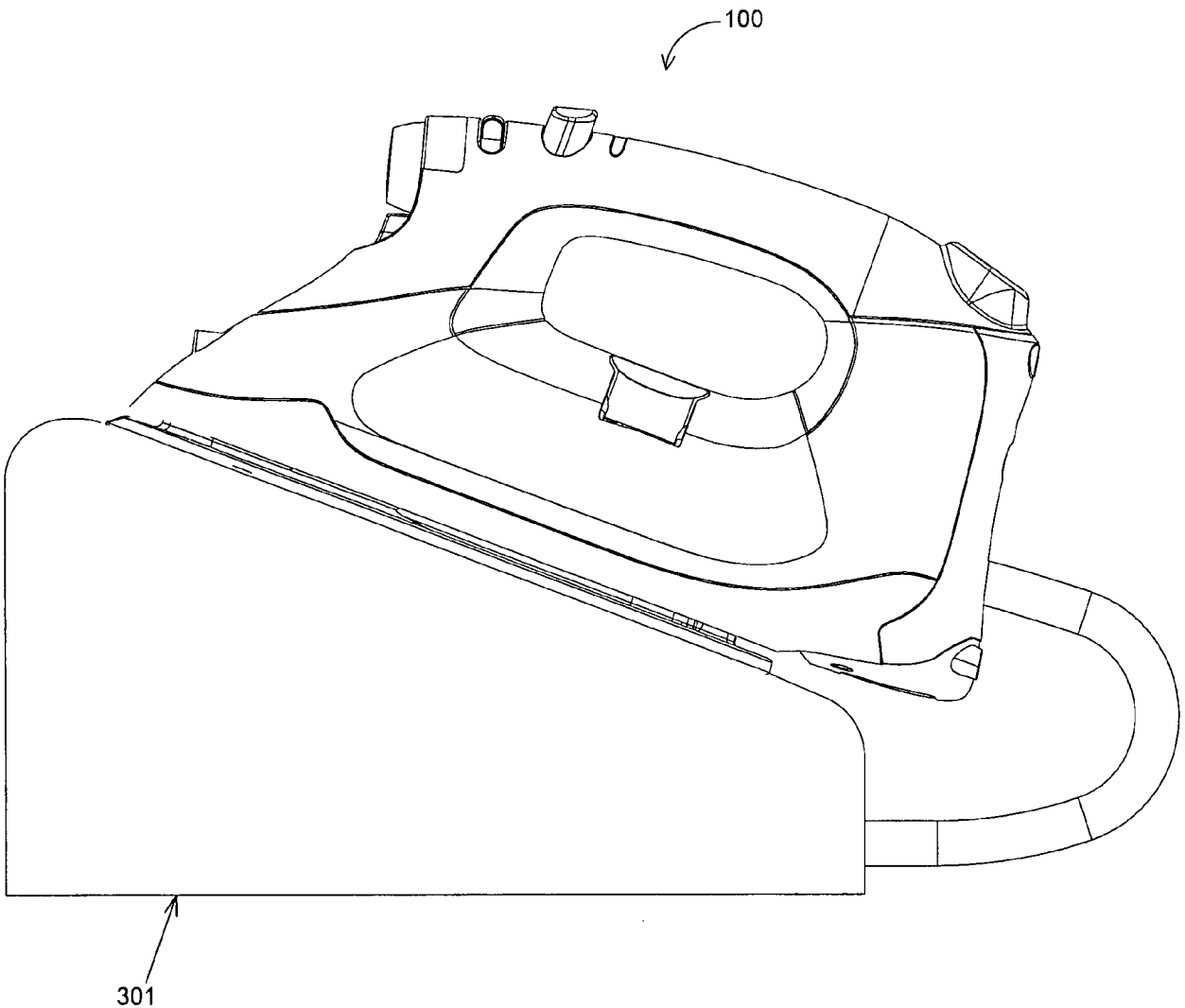
FIG. 19 shows an embodiment of the iron of the invention including an external steam generation apparatus.

FIG. 19 shows an embodiment of the invention including a separate steam generating apparatus 301 that may be coupled to the iron 100 in gas communication with the steam chamber of the iron 100 so that the iron 100 can emit a continuous stream of steam.

Figure 20:
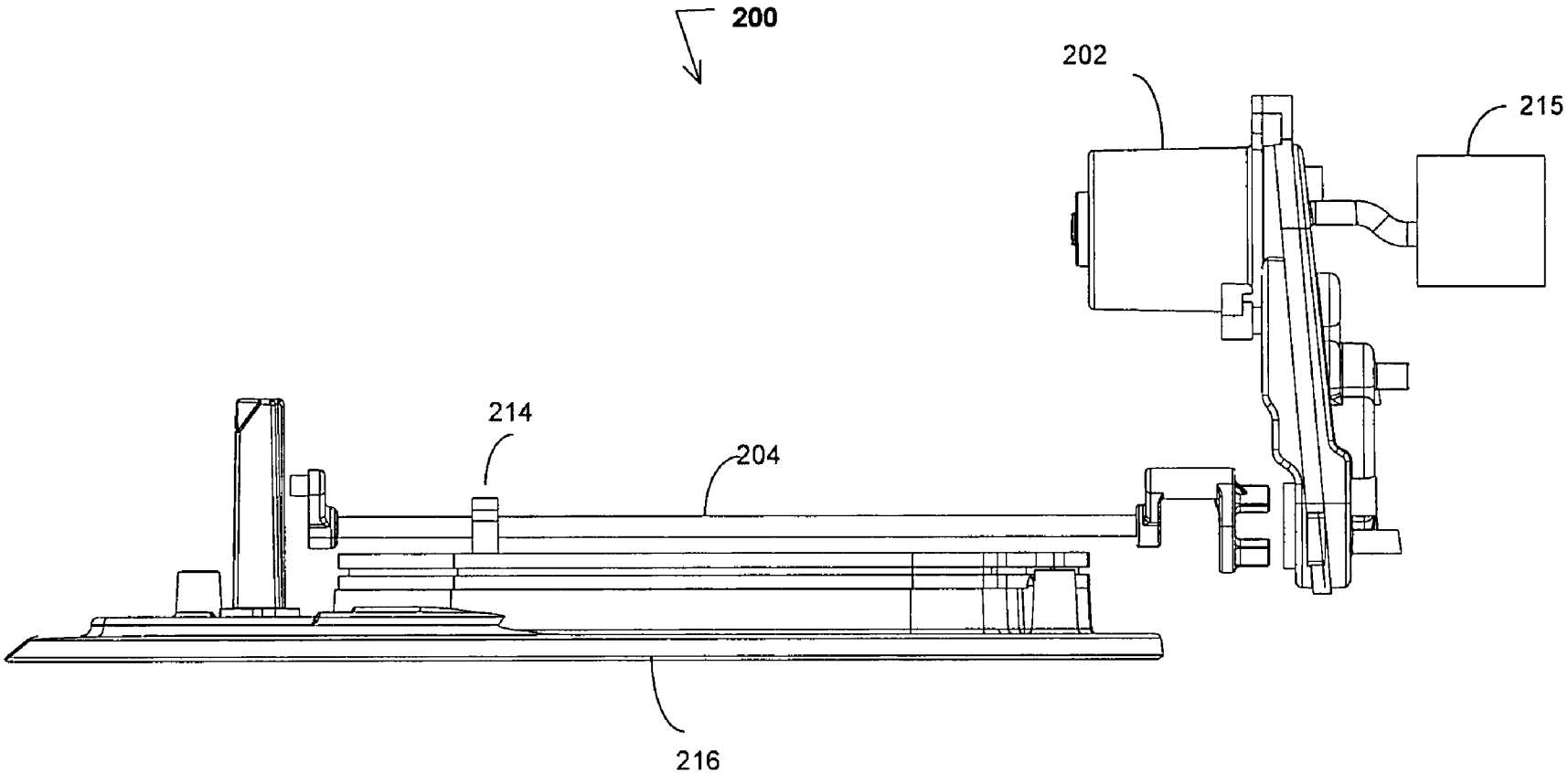
FIG. 20 shows an embodiment in which the motor turns the cam and the water pump.

FIG. 20 shows an embodiment of the invention wherein the motor 202 can be turned in either direction, and is geared so that in one direction the motor acts on the cam 204, and in the other direction, the motor 202 acts on the water pump 215. In some embodiments, it may be preferable for the motor 202 to be prevented from acting on the water pump 215 when the legs are extended.

While the present invention has been described with reference to several particular example embodiments, those skilled in the art will recognize that many changes may be made thereto without departing from the spirit and scope of the present invention, which is set forth in the following claims.

What is claimed is:

1. An iron comprising:

an electrically heated soleplate;

a handle;

a separation mechanism including at least one lifting leg for lifting a bottom surface of said heated soleplate away from a supporting surface;

a sensor disposed in said handle providing for control of said separation mechanism, wherein, when said sensor detects the hand of the user, said sensor sends a signal to said separation mechanism to lower the iron by retracting said separation mechanism, and when the user releases said handle said sensor signals said separation mechanism to raise the iron.

2. The iron of claim 1, further comprising a position sensor for detecting a lift height of said separation mechanism, and for using feedback from said position sensor to control said separation mechanism.

3. The iron of claim 2, wherein said separation mechanism includes a DC motor having a gear box for converting a high rpm low torque output of said DC motor into a low rpm high torque output.

4. The iron of claim 1, wherein said legs comprise a material selected to have lower thermal conductivity than said thermal conductivity of said soleplate.

5. The iron of claim 1, wherein said legs comprise a material selected to have a higher coefficient of friction than said coefficient of friction of sole plate.

6. The iron of claim 1, further comprising an insulation having a thermal conductivity lower than a thermal conductivity of said sole plate positioned between said at least one leg and said heated soleplate.

7. The iron of claim 1, further comprising a heat conducting, low thermal mass pad disposed on a bottom of said contact foot, said low thermal mass pad being recessable into a corresponding relief in said soleplate so as to provide a uniform soleplate heating surface when said separation mechanism retracts said at least one leg.

8. The iron of claim 1, wherein said at least one leg includes a rear leg positioned outside said soleplate, and including an air gap between said rear leg and said soleplate, said air gap acting as an insulating layer.

9. The iron of claim 1, further comprising a sealing device for inhibiting moisture from passing from a bottom of said soleplate into an interior of the iron.

10. The iron of claim 9, further comprising a physical barrier positioned between said separation mechanism and other components in said interior of the iron.

11. The iron of claim 1, further comprising a water barrier positioned over said at least one leg to inhibit water from passing between said at least one leg and said sole plate into an interior of the iron.

12. The iron of claim 1, further comprising a water valve providing water to a steam chamber only when said at least one leg is retracted.

13. The iron of claim 12, further comprising a set of cams mounted on a drive shaft to control movement of said separation mechanism and to actuate a valve for controlling water flow allowing steam production only when said separation mechanism is retracted.

14. The iron of claim 1, further comprising a valve allowing water to enter a steam chamber in the iron allowing a user to apply constant steam when the iron is in a non-horizontal position, to steam hanging clothes.

15. The iron of claim 1, further comprising a water filling port located on a side or a top of a housing of the iron so the user can fill the iron in a horizontal position.

16. The iron of claim 1, further comprising a flip-out fill port on a side of the iron for filling of the iron while the iron is standing in a roughly horizontal position on, and including means for creating a water-tight seal when said fill port is flipped closed.

17. The iron of claim 1, further comprising a switch to disable lifting by said separation mechanism.

18. The iron of claim 17, further comprising a timer and position sensor for detecting if the iron has not been used for a selected period of time, and providing for actuation of said separation mechanism to extend said at least one leg when selected period of time has passed, even if said switch was used to disable lifting by said separation mechanism.

19. The iron of claim 1, further comprising a timer and position sensor for detecting if the iron has not been used for a selected period of time, and for turning off power to said soleplate when said selected period time has elapsed.

20. The iron of claim 1, wherein said separation mechanism maintains the iron in a horizontal orientation, and includes at least one of a member of the group comprising a motor, a servo, or a solenoid, and further including a rotating drive shaft with cams that slide in slots on the at least one leg.

21. The iron of claim 1, wherein the separation mechanism operates to rotate the iron up on to a heel of the iron by shifting a center of gravity.

22. The iron of claim 1, wherein said separation mechanism lifts and lowers said sole plate at a variable rate over a total period of time, including a slower initial acceleration, a faster middle acceleration, and an ending deceleration.

23. The iron of claim 22, wherein a plot of acceleration over time of the lifting of said sole plate resembles an S-curve.

24. The iron of claim 22, wherein a plot of acceleration over time of the lowering of said sole plate resembles an S-curve.

25. The iron of claim 1, wherein the user may select a time delay between when the user releases said handle and said separation mechanism extends said at least one leg to raise the iron.

26. The iron of claim 1, wherein motion of a drive shaft of said separation mechanism is used to inhibit mineral build-up.

27. The iron of claim 1 wherein the sensor is a manually operated switch.

28. The iron of claim 12 further comprising an external steam generating apparatus in gas communication with a steam chamber of the iron.

29. The iron of claim 3 wherein said motor can turn in either direction, and wherein said motor acts on said cam shaft when turned in a first direction and acts on a water pump when turned in an opposite second direction.

30. An iron comprising:

a sole plate, a handle, and a housing comprising a flip-out water filling port located on a side or a top of a housing of the iron so the user can fill the iron in a horizontal position, said water filling port further comprising a funnel and a ball pivot, said ball pivot including a fluid conduit.

* * * * *